US011723510B2

(12) United States Patent
Jairam et al.

(10) Patent No.: US 11,723,510 B2
(45) Date of Patent: Aug. 15, 2023

(54) SOLID DETERGENT DISPENSER FOR A WASHING MACHINE

(71) Applicant: Ecolab USA Inc., Saint Paul, MN (US)

(72) Inventors: Rahul Bharath Jairam, Minneapolis, MN (US); Daniel Davis Anderson, Eagan, MN (US); Steven James Lundberg, Minneapolis, MN (US); Thomas David LaVenture, Lakeland, MN (US); Marvin Harris York, Minneapolis, MN (US); Michael Patrick Kremer, Rosemount, MN (US)

(73) Assignee: Ecolab USA Inc., Saint Paul, MN (US)

( * ) Notice: Subject to any disclaimer, the term of this patent is extended or adjusted under 35 U.S.C. 154(b) by 141 days.

(21) Appl. No.: 17/131,158

(22) Filed: Dec. 22, 2020

(65) Prior Publication Data

US 2021/0186298 A1 Jun. 24, 2021

Related U.S. Application Data

(60) Provisional application No. 62/952,844, filed on Dec. 23, 2019.

(51) Int. Cl.
*A47L 15/44* (2006.01)
*A47L 15/42* (2006.01)

(52) U.S. Cl.
CPC ..... *A47L 15/4436* (2013.01); *A47L 15/4244* (2013.01); *A47L 15/449* (2013.01); *A47L 15/4445* (2013.01); *A47L 2501/07* (2013.01)

(58) Field of Classification Search
CPC ..... A47L 15/4436; A47L 15/4244; A47L 15/4445; A47L 15/449; A47L 2501/07; A47L 15/4246; A47L 15/0055
See application file for complete search history.

(56) References Cited

U.S. PATENT DOCUMENTS 1,904,157 A 4/1933 Raymond
2,554,393 A 5/1951 Leslie
(Continued)

FOREIGN PATENT DOCUMENTS

DE 2324185 11/1974
DE 19836857 9/2001
(Continued)

OTHER PUBLICATIONS

"International Application Serial No. PCT/US2020/066687, International Search Report dated Mar. 15, 2021", 5 pgs.
(Continued)

*Primary Examiner* — Michael E Barr
*Assistant Examiner* — Pallavi Chitta
(74) *Attorney, Agent, or Firm* — Schwegman Lundberg & Woessner, P.A.

(57) ABSTRACT

A system for dispensing a detergent solution from a solid detergent into a dishwasher includes a dispenser that can collect water sprayed into the dishwasher and use the collected water to produce the detergent solution by dissolving a portion of the solid detergent, controlling the amount of the detergent solution produced, and releasing the produced detergent solution between cleaning cycles. The dispenser can perform these functions automatically without being electrically powered.

20 Claims, 10 Drawing Sheets

(56) References Cited

U.S. PATENT DOCUMENTS

| | | | | |
|---|---|---|---|---|
| 5,137,694 | A * | 8/1992 | Copeland | A47L 15/4436 422/106 |
| 5,176,297 | A | 1/1993 | Mooney et al. | |
| 5,593,648 | A | 1/1997 | Christie et al. | |
| 5,967,158 | A | 10/1999 | Smith et al. | |
| 6,048,501 | A | 4/2000 | Lemaire et al. | |
| 6,773,668 | B1 | 8/2004 | Everson et al. | |
| 7,578,303 | B2 | 8/2009 | Daume et al. | |
| 7,845,361 | B1 | 12/2010 | Verespej et al. | |
| 8,536,107 | B2 | 9/2013 | Hahn | |
| 8,578,950 | B2 | 11/2013 | Rosenbauer et al. | |
| 8,721,804 | B2 | 5/2014 | Beshears, Jr. et al. | |
| 8,734,591 | B2 | 5/2014 | Beshears, Jr. et al. | |
| 9,144,366 | B2 | 9/2015 | Oner | |
| 9,610,001 | B2 | 4/2017 | Classen et al. | |
| 10,098,519 | B2 | 10/2018 | Willey et al. | |
| 2004/0163675 | A1 | 8/2004 | Hanh et al. | |
| 2005/0039781 | A1 | 2/2005 | Song et al. | |
| 2011/0180118 | A1 | 7/2011 | Schrott | |
| 2017/0042404 | A1* | 2/2017 | Kan | A47L 15/4257 |
| 2017/0158988 | A1* | 6/2017 | Lo | C11D 1/94 |

FOREIGN PATENT DOCUMENTS

| | | | |
|---|---|---|---|
| DE | 10049316 | | 1/2002 |
| DE | 19935728 | | 7/2003 |
| DE | 102010003766 | | 10/2011 |
| EP | 0461870 | | 12/1991 |
| EP | 0823236 | | 2/1998 |
| EP | 0878164 | | 11/1998 |
| EP | 0678275 | | 9/1999 |
| EP | 3106075 | | 12/2016 |
| EP | 3106075 | A1 * | 12/2016 |
| GB | 2339678 | | 2/2000 |
| WO | 9606666 | | 3/1996 |
| WO | 2021133834 | | 7/2021 |

OTHER PUBLICATIONS

"International Application Serial No. PCT/US2020/066687, Written Opinion dated Mar. 15, 2021", 8 pgs.

* cited by examiner

SOLID DETERGENT DISPENSER FOR A WASHING MACHINE

CROSS-REFERENCE TO RELATED APPLICATION

This patent application claims the benefit of U.S. Provisional Patent Application No. 62/952,844, filed Dec. 23, 2019, entitled "SOLID DETERGENT DISPENSER FOR A WASHING MACHINE", which is incorporated by reference herein in its entirety.

TECHNICAL FIELD

This application relates generally to detergent dispensing and more particularly to a method and apparatus for dispensing a solid detergent in a washing machine such as a dishwasher.

BACKGROUND

A dishwasher, also referred to as a warewasher or warewashing machine, is a machine for automatically cleaning articles, such as dishes, trays, laboratory equipment, dinnerware, and kitchenware. A batch of objects to be cleaned (for example, dishes) can be loaded into a tub of the dishwasher, typically including racks and utensil holders, to be cleaned in a cleaning cycle that include washing and rinsing periods. During the washing period, a cleaning mixture formed by water and dishwasher detergent is sprayed into the loaded tub to blast the dishes. The cleaning mixture is then drained before the rinsing period starts. During the rinsing period, water is sprayed into the washing chamber to remove residue of the cleaning mixture. After the rinsing period complete with the rinsing water being drained, the dishes can optionally be dried using air and/or heat during a drying period. A dishwasher may have various user-selectable settings for each cleaning cycle. The settings may define, for example, time, temperature, and repetition of each of the washing, rinsing, and drying period. The setting may also allow the user to choose which periods to include (e.g., rinsing only, drying only, rinsing and drying, or washing and rinsing without drying).

A common domestic dishwasher is an undercounter unit intended to be installed under a kitchen counter. Other types of dishwasher include industrial or commercial dishwashers for use in restaurants, hotels, and other commercial establishments with food services. Dishwasher detergents used in these dishwashers can include chemicals capable of cleaning, sanitizing, and/or reducing surface tension of water (and hence water spots on dishes). Such dishwasher detergents are made into various solid and liquid forms. Solid dishwasher detergents include chemicals made in forms of solid blocks such as tablets in various shapes.

SUMMARY

A system for dispensing a detergent solution from a solid detergent into a dishwasher includes a dispenser that can collect water sprayed into the dishwasher and use the collected water to produce the detergent solution by dissolving a portion of the solid detergent, controlling the amount of the detergent solution produced, and releasing the produced detergent solution into the dishwasher. The dispenser can perform these functions automatically without being electrically powered.

In one example, a system for dispensing a detergent solution from a solid detergent into a dishwasher may include a detergent chamber, a liquid inlet, a liquid outlet, and a liquid level control mechanism. The detergent chamber may be configured to accommodate the solid detergent and the detergent solution. The liquid inlet is in fluid communication with the detergent chamber and may be configured to collect water sprayed into the dishwasher during washing and rinsing periods and to allow the collected water to flow into the detergent chamber to form the detergent solution by dissolving a portion of the solid detergent. The liquid outlet is in fluid communication with the detergent chamber and may be configured to automatically release the detergent solution from the detergent chamber. The liquid level control mechanism may be configured to set a liquid height limiting a level of the detergent solution in the detergent chamber. In various examples, the liquid outlet may be configured to automatically release the detergent solution from the detergent chamber between two consecutive cleaning cycles of the dishwasher. In various examples, the liquid level control mechanism may be configured to adjustably set the liquid height.

In another example, a method for operating a detergent dispensing system in a dishwasher is provided. The method may include holding a solid detergent in a detergent chamber of the detergent dispensing system, collecting a portion of water sprayed into the dishwasher during washing and rinsing periods, using the collected water to form a detergent solution in the detergent chamber by dissolving a portion of the solid detergent, automatically releasing the detergent solution from the detergent chamber, and setting a liquid height using mechanical means. The liquid height limits a level of the detergent solution in the detergent chamber. In various examples, the detergent solution may be automatically released from the detergent chamber between two consecutive cleaning cycles of the dishwasher. In various examples, the liquid height may be adjustable using the mechanical means.

This summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

The drawings illustrate generally, by way of example, various embodiments discussed in the present document. The drawings are for illustrative purposes only and may not be to scale.

DETAILED DESCRIPTION

Figure 1:
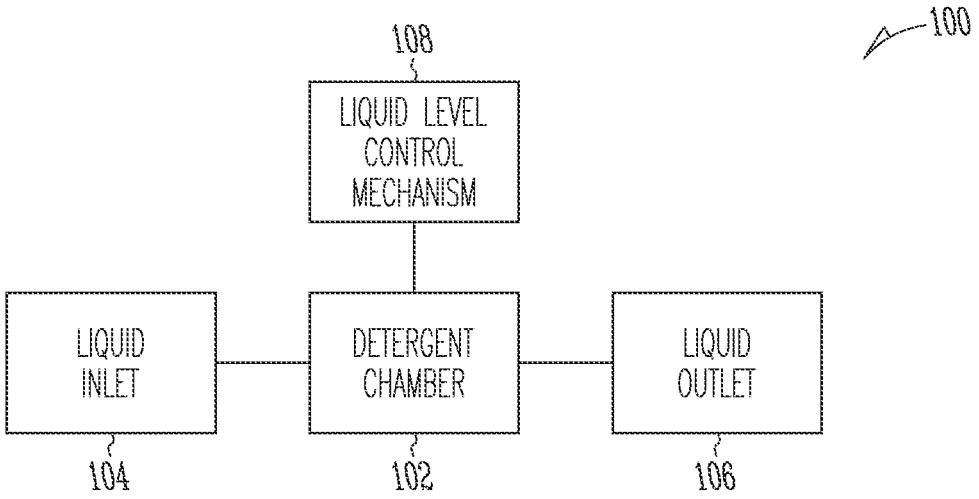
FIG. 1 is a block diagram illustrating an embodiment of a detergent dispensing system for use in a dishwasher.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The scope of the present invention is defined by the appended claims, along with the full scope of legal equivalents to which such claims are entitled.

This application discusses, among other things, a system for dispensing solid detergent in a dishwasher that can be internally mounted and allow for each load of the solid detergent to last for multiple cleaning cycles. Compared to existing examples of solid detergent dispensers, the present subject matter provides a dispenser for solid detergent blocks that is easier to produce (e.g., without need of electronics or water sprayer) and easier to use (e.g., substantially automatic detergent dispense, with detergent loaded between multiple cleaning cycles), while providing each cleaning cycle with substantially consistent amount and concentration of detergent solution. In various embodiments, the dispenser can be made spatially and functionally retrofittable to many dishwashers, including undercounter dishwashers for home use, to allow for use of solid detergent blocks as an option in addition to existing option(s) provided by built-in detergent dispensers. In various embodiments, the dispenser according to the present subject matter can hold one or more solid detergent blocks, receive water during washing and rinsing periods of a cleaning cycle to dissolve a portion of the solid detergent block(s) with a substantially even erosion, and release the resulting detergent solution into the tub of the dishwasher before the next cleaning cycle, with the amount of resulting detergent solution controllable by the liquid level allowed in the detergent holder.

Among other advantages, the present solution eliminates the need for adding dishwasher detergent before every cleaning cycle. It also adds to the consistency of concentration and amount of detergent dispensed by the system. Solid detergent block is a safer alternative to liquid detergent. The solid block form of a detergent is more concentrated than its liquid form, is not associated with risk of spilling, and may not need personal protective equipment. Solid detergent blocks also provide sustainability benefits from packaging and water content reduction as well as a smaller storage footprint at customer locations.

In this application, a "dishwasher", which can also be referred to as warewasher or warewashing machine, includes any type of wash machine that can use detergent for cleaning and/or sanitizing purposes. One example includes an undercounter dishwasher for washing dinnerware, flatware, pots and pans, cutlery, flatware, glasses, kitchenware, serving pans, trays, and so on. Commercial dishwashing equipment examples can also use the present subject matter. A dishwasher includes a washing tub formed by interior walls and a door of the dishwasher. In an example of the undercounter kitchen dishwasher, the door rotates up to about 90 degrees about a horizontal axis to switch between a fully closed state and to a fully open state. The door has an interior side and an exterior side that are both substantially vertical when the door is fully closed and substantially horizontal when the door is fully open.

A "cleaning cycle" can include other periods, such as one or more of a washing period, a rinsing period, and a drying period, depending on settings made by a user of the dishwasher. The door is opened at least once between two consecutive cleaning cycles to allow loading of the dishes and/or other objects to be cleaned and unloading of the cleaned dishes and/or other objects. "Cleaning" can include cleaning only, sanitizing only, or cleaning and sanitizing, depending on, for example, whether the solid detergent blocks are capable of cleaning only, sanitizing only, or cleaning and sanitizing. A "washing period" includes a period or operational mode that is intended for a cleaning mixture formed by water and detergent to be applied to the dishes and/or other objects. A "rinsing period" includes a period or operational mode that is intended for water, or water and a chemical rinsing aid and/or a chemical sanitizer, to be applied to the dishes and/or other objects. Some dishwashers (e.g., commercial dishwashers) may include a rinsing period that is primarily for sanitizing through heat and/or chemical means. A "drying period" includes a period or operational mode that is intended for the cleaned dishes and/or other objects to be dried by air flow and/or heat, without additional water and/or detergent applied. The dishwasher usually allows the user to choose whether to include the drying period in the cleaning cycle because the user can open the dishwasher door to allow the washed and rinsed dishes to dry naturally or remove the washed and rinsed dishes to another place for drying.

Application in a dishwasher is discussed as an example, but not a limitation, for the present subject matter. The present system for dispensing solid detergent can be applied in any washing machine that sprays water that can be collected to dissolve a portion of a solid detergent during a cleaning cycle.

FIG. 1 is a block diagram illustrating an embodiment of a detergent dispensing system 100 for use in a dishwasher. The dishwasher has a door providing for access to a tub, and can perform cleaning cycles each including washing and rinsing periods during which water is sprayed into the tub. System 100 can be installed inside the dishwasher for dispensing a detergent solution from a solid detergent into a dishwasher. System 100 can perform its functions automatically and is not electrically powered.

System 100 includes a detergent chamber 102, a liquid inlet 104, a liquid outlet 106, and a liquid level control mechanism 108. Detergent chamber 102 can accommodate the solid detergent and the detergent solution. Liquid inlet 104 is in fluid communication with detergent chamber 102 and can collect water sprayed into the dishwasher during the washing and rinsing periods and allow the collected water to flow into detergent chamber 102 to form the detergent solution by dissolving a portion of the solid detergent. Liquid outlet 106 is in fluid communication with the detergent chamber and can automatically release the detergent solution from detergent chamber 102 between two consecutive cycles of the cleaning cycles (i.e., after completion of a cleaning cycle and before beginning of the next cleaning cycle, when the dishwasher is not run). Liquid level control mechanism 108 can set a liquid height that limits a level of the detergent solution in detergent chamber 102. In various embodiments, a liquid level control mechanism 108 is a non-electrical mechanism and uses one or more mechanical features and/or characteristics of system 100 to set the liquid height.

Figure 2:
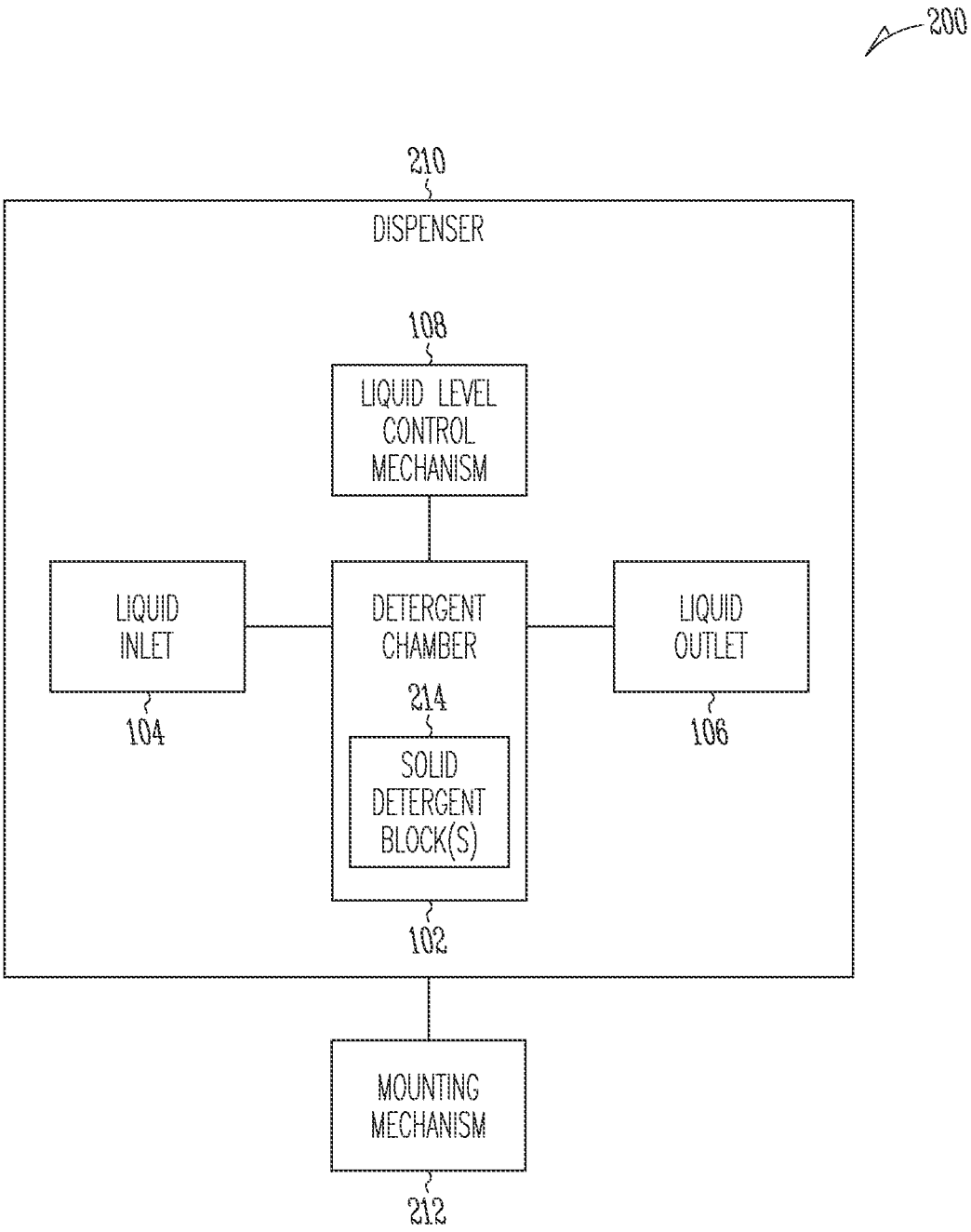
FIG. 2 is a block diagram illustrating an embodiment of a detergent dispensing system that is retrofittable into a dishwasher and contains one or more blocks of solid detergent.

FIG. 2 is a block diagram illustrating an embodiment of a detergent dispensing system 200. System 200 includes system 100 implemented in a dispenser 210 with one or more solid detergent blocks 214 contained in detergent chamber 102 and a mounting mechanism 212 allowing dispenser 210 to be retrofitted into a dishwasher.

Solid detergent block(s) 214 are each a solid detergent in a form of a solid block. The solid detergent is a water-soluble chemical in a form of a solid block that can be used for cleaning and/or sanitizing objects being washed in the dishwasher. In one embodiment, the solid block has a shape of a rectangular tablet. When desired, the rectangular tablet can be made with rounded edges and/or corners. In other embodiments, the solid block can be in any shape allowing for substantially even dissolution in water according to the present subject matter, such as cylindrical tablets and spherical tablets. In various embodiments, the solid detergent can include a washing agent (which can also be referred to as a cleaning agent or a detergent), the washing agent and a rinsing agent (which can also be referred to as a rinsing aid), or the washing agent, the rinsing agent, an a sanitizing agent. In various embodiments, the solid detergent can include any one or any combination of the washing agent, the rinsing agent, and the sanitization agent. The solid detergent that include all three (the washing agent, the rinsing agent, and the sanitization agent) can be referred to as an "three-in-one" or "all-in-one" detergent.

Dispenser 210 includes detergent chamber 102, liquid inlet 104, liquid outlet 106, and liquid level control mechanism 108. While system 100 or dispenser 210 can be built into a dishwasher during its manufacture, mounting mechanism 212 allows dispenser 210 to be retrofittable into an existing dishwasher. Retrofitting dispenser 210 into an existing dishwasher provides consumers with an option of using anew type of detergent without requiring anew dishwasher. Dispenser 210 can perform its functions automatically and is not electrically powered.

Detergent chamber 102 can accommodate solid detergent block(s) 214 and the detergent solution formed from solid detergent block(s) 214. In various embodiments, detergent chamber 102 can include a detergent opening to receive solid detergent block(s) 214 into detergent chamber 102 and a lid to close the detergent opening to retain the received block(s).

Liquid inlet 104 is positioned and oriented to naturally collect water sprayed into the dishwasher during the washing and rinsing periods (or any periods during which water is sprayed into the dishwasher) and to naturally allow the collected water to flow into detergent chamber 102 to form the detergent solution by dissolving a portion of solid detergent block(s) 214. Being "natural" means no additional force or energy is required to operate the dishwasher for collecting the water and directing its flow into detergent chamber 102. In one embodiment, liquid inlet 104 is also positioned and oriented to limit a height of the liquid held in detergent chamber 102. In various embodiments, liquid inlet 104 can include one or more openings on detergent chamber to partially expose detergent chamber 102 to the water sprayed into the dishwasher, one or more water channels to collect the water and guide the collected water into the detergent chamber, and/or a funnel with a conduit to collect the water and pass the collected water into detergent chamber 102.

In various embodiments, liquid outlet 106 can include a valve controllable for releasing the detergent solution formed and held in detergent chamber 102 between two consecutive cleaning cycles of the dishwasher. In one embodiment, the valve can be actuated by the door of the dishwasher, such that a release of the detergent solution starts in response to an opening of the door of the dishwasher. Thus, the detergent solution is released after completion of each cleaning cycle and remains ready to be used for the next cleaning cycle. This avoids sitting water inside detergent chamber 102 to maintain cleanness and extend life of dispenser 210. In another embodiment, liquid outlet 106 is positioned and oriented to allow the detergent solution to flow out of detergent chamber 102 through one or more openings of detergent chamber 102 when the door of the dishwasher is open. In various other embodiments, liquid outlet 106 allows for release of the detergent solution formed and held in detergent chamber 102 and can include an opening sized to control a speed of the release. In these various other embodiments, liquid outlet 106 may or may not include a valve (e.g., for controlling the size of the opening), and the detergent solution is released continuously through liquid 106 until detergent chamber 102 is empty.

Liquid level control mechanism 108 can set the liquid height limiting a level of the detergent solution in detergent chamber 102 using one or more mechanical features and/or characteristics of dispenser 210. This liquid height approximately determines an amount of detergent solution in detergent chamber 102, while the exact amount depends on a degree of erosion of solid detergent block(s) 214 under the liquid height. In various embodiments, the liquid height can be pre-fixed or adjustable (e.g., by a user of the dishwasher). In various embodiments, liquid level control mechanism 108 can be implemented in liquid inlet 104 and/or detergent chamber 102. For example, liquid inlet 104 can be positioned and/or oriented to stop collecting the water after the level of the detergent solution in detergent chamber 102 reaches the liquid height, or detergent chamber 102 can be configured to limit its liquid capacity. In various embodiments, liquid level control mechanism 108 can substantially stop the water from flowing into detergent chamber 102, thereby substantially stopping the detergent solution from overflowing from detergent chamber 102, after a level of the detergent solution in the detergent chamber reaches the liquid height. Liquid level control mechanism 108 is designed to control the rate at which the water enters detergent chamber 102 to avoid turbulence causing the detergent solution to fully mix with the water and risk overflow from detergent chamber 102. The heightened density of the detergent solution would help mitigate the overflowing of the detergent solution so that the water being displaced and pushed out of detergent chamber 102 is water containing little or no detergent.

Mounting mechanism 212 allows dispenser 210 to be internally mounted in the dishwasher. In various embodiments, mounting mechanism 212 allows dispenser 210 to be mounted in a location within the dishwasher without interfering with operation of the dishwasher, without substantially impacting load capacity of the dishwasher. In various embodiments, mounting mechanism 212 allows dispenser 210 to be attached to an interior surface or another structure of the dishwasher. In some embodiments, mounting mechanism 212 allows dispenser 210 to be detachably attached to the interior surface or other structure of the dishwasher. This allows dispenser 210 to be detached from the dishwasher for cleaning dispenser 210 as well as areas in the dishwasher behind dispenser 210, periodically or as needed, to avoid food soil and/or detergent buildup. In one embodiment, mounting mechanism 212 includes a mounting structure (e.g., a mounting plate or pole) that can be installed in the dishwasher, and dispenser 210 can be detachably attached to the mounting structure. The mounting structure may be intended for installation by a trained technician, then a customer should be able to attach and detach dispenser 210 easily.

Figure 3:
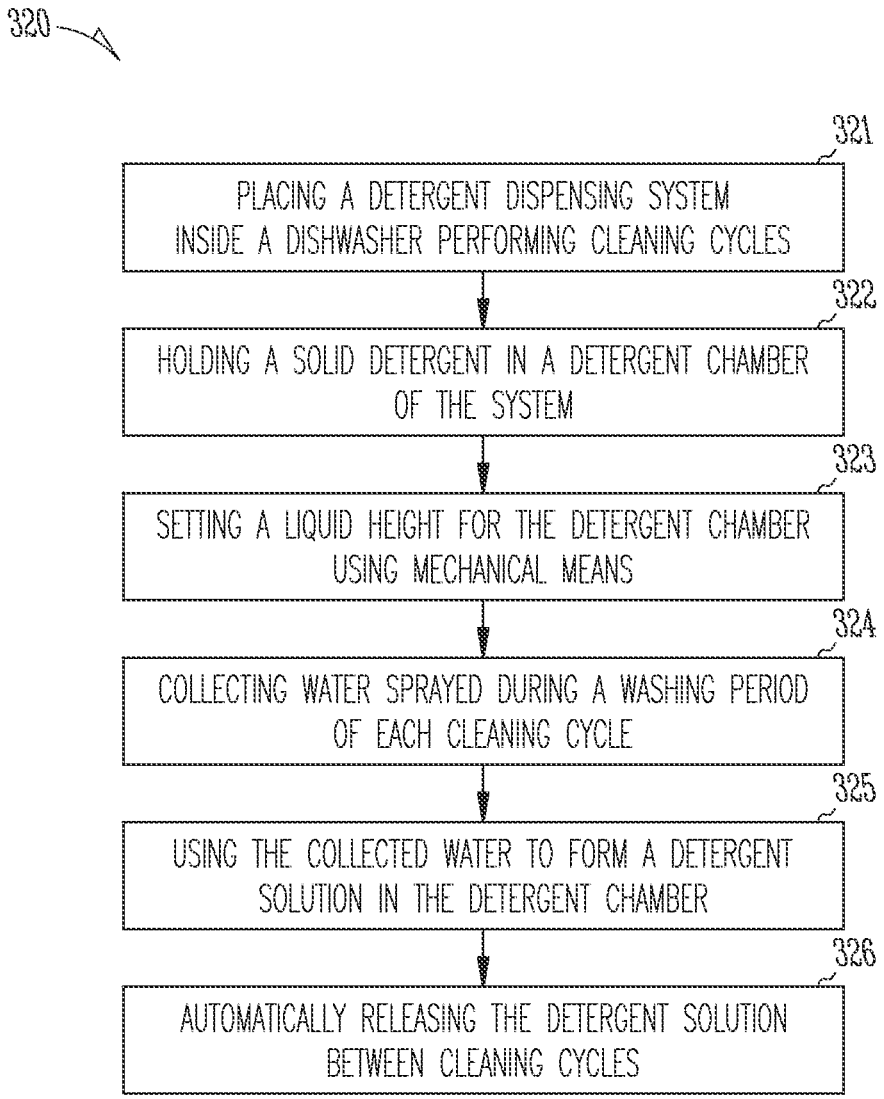
FIG. 3 is a flow chart illustrating an embodiment of a method for dispensing a solid detergent in a dishwasher.

FIG. 3 is a flow chart illustrating an embodiment of a method 320 for dispensing a solid detergent in a dishwasher that performs cleaning cycles. Method 320 can be performed using system 100 or system 200, including various embodiments of their components such as those discussed below with reference to FIGS. 4-11.

At 321, a detergent dispensing system is placed inside the dishwasher. This can include retrofitting a dispenser into the dishwasher, such as by mounting the dispenser on an interior wall or another structure of the dishwasher.

At 322, a solid detergent is held in a detergent chamber of the detergent dispensing system. The solid detergent can include one or more solid blocks. Each solid block can be in the form of a rectangular tablet, or in any other form allowing for substantially even dissolution in water when held in the detergent chamber (e.g., cylindrical or spherical tablets). In various embodiments in which multiple solid blocks can be held in the detergent chamber, one or more additional solid blocks can be loaded before the held one or more solid blocks are completely dissolved.

At 323, a liquid height is set for the detergent chamber using mechanical means (i.e., non-electrical means). The liquid height limits the amount of a detergent solution that can be held in the detergent chamber. Examples of the mechanical means includes a gate on the detergent chamber and position and/or orientation of a liquid inlet that collects water and allows the water to flow into the detergent chamber.

At 324, water sprayed during each cleaning cycle (e.g., during the washing and rinsing periods) is collected. In various embodiments, a portion of water sprayed into the dishwasher during the washing and rinsing periods is collected using one or more opening on the detergent chamber, one or more channels connected to the detergent chamber, and/or one or more funnels connected to the detergent chamber.

At 325, the collected water is used to form the detergent solution in the detergent chamber. The collected water flows into the detergent chamber to dissolve a portion of the solid detergent held in the detergent chamber, resulting in the detergent solution also held in the detergent chamber.

At 326, the detergent solution is automatically released from the detergent chamber between two consecutive cycles of the cleaning cycles. Because the door of the dishwasher is closed during each cleaning cycle, the detergent solution can be automatically released in response to the door being opened. In various embodiments, a door-actuated valve is used to release the detergent solution from the detergent chamber when the door is open.

Figure 4:
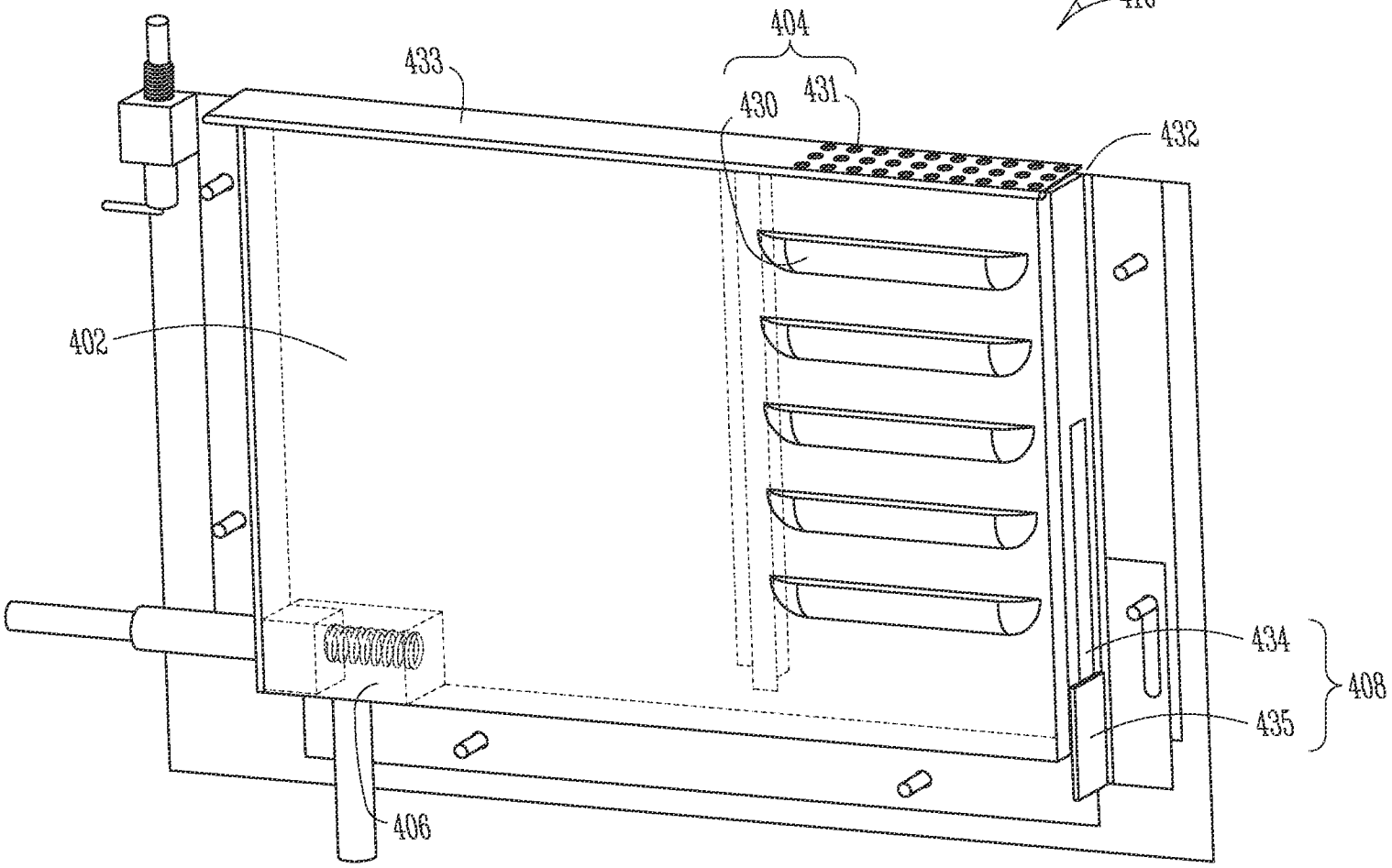
FIG. 4 is an illustration of an embodiment of a dispenser, such as may be implemented as the dispenser in the detergent dispensing system of FIG. 1 or FIG. 2.

FIG. 4 is an illustration of an embodiment of a dispenser 410 for dispensing a detergent solution from a solid detergent into a dishwasher. Dispenser 410 represents an example of implementation of system 100 or an example of dispenser 210, and includes a detergent chamber 402, a liquid inlet 404, a liquid outlet 406, and a liquid level control mechanism 408.

Detergent chamber 402 represents an example of detergent chamber 102 and can accommodate one or more blocks of the solid detergent and the detergent solution. In one embodiment, detergent chamber 102 accommodates multiple blocks of the solid detergent and allows for loading additional one or more blocks of the solid detergent before the solid detergent in detergent chamber 102 is completely dissolved. Detergent chamber 402 includes a detergent opening 432 to receive the one or more solid blocks and a lid 433 to close detergent opening 432. In the illustrated embodiment, detergent opening 432 is at a top of detergent chamber 402, and the lid includes holes 431 to allow entry of water during the washing and rinsing periods. Detergent chamber 402 can have a size suitable for mounting inside a dishwasher with minimal or no effect on the dishwasher's loading capacity and functioning. As an example, detergent chamber 402 can have a length between 25 and 45 cm, a width between 18 and 38 cm, and a height (thickness) of 1.5 and 3.5 cm, with approximately 34 cm×28 cm×2.5 cm being a specific example.

Liquid inlet 404 represents an example of liquid inlet 104 and can include one or more holes 431 and/or one or more water channels 430. In the illustrated embodiment, liquid inlet 404 includes multiple holes 431 and multiple water channels 430. In other embodiments, liquid inlet 404 can include any number of holes 431 and/or water channels 430 that allows for sufficient water to enter detergent chamber 402 to form the desirable amount of detergent solution. Water channels 430 are in fluid communication with detergent chamber 402 and are positioned and oriented to naturally collect the water sprayed during the washing and rinsing periods and guide the collected water into detergent chamber 402 for dissolving a portion of the solid detergent held in detergent chamber 402 to form the detergent solution.

Liquid outlet 406 represents an example of liquid outlet 106. In the illustrated embodiment, liquid output 406 includes a door-actuated valve. The valve is opened to release the detergent solution from detergent chamber 402 by opening the door of the dishwasher, and remains open while the door of the dishwasher is open. In other embodiments, liquid outlet 406 allows for release of the detergent solution formed and held in detergent chamber 402 and can include an opening sized to control a speed of the release. In such other embodiments, liquid outlet may or may not include a valve (e.g., for controlling the size of the opening). Once formed in detergent chamber 402, the detergent solution is released continuously through liquid outlet 406 until detergent chamber 402 is empty.

Liquid level control mechanism 408 represents an example of liquid level control mechanism 108 and includes a level control opening 434 and a gate 435. Level control opening 435 is on detergent chamber 402. Gate 435 sets the liquid height in detergent chamber 402 by functioning as a dam that partially blocks level control opening 435. In the illustrated embodiment, level control opening 434 is a slot on a side of the detergent chamber, and gate 434 a sliding gate having an upper edge setting the liquid height.

Figure 5:
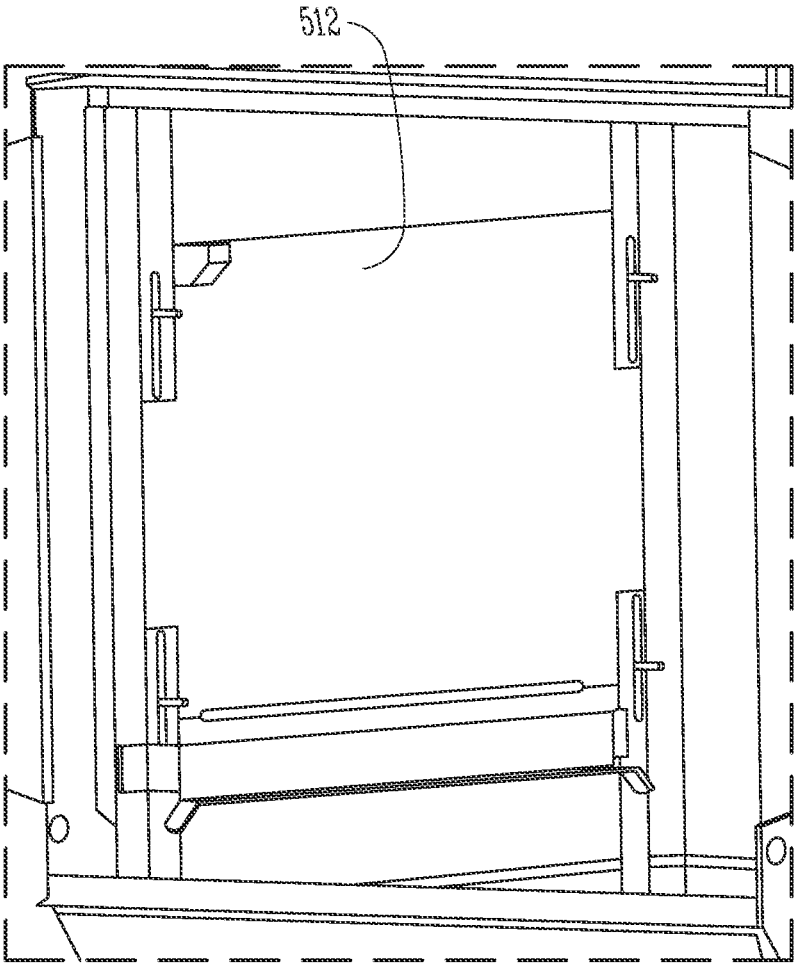
FIG. 5 is an illustration of an embodiment of a mounting plate for the dispenser of FIG. 4.
Figure 6:
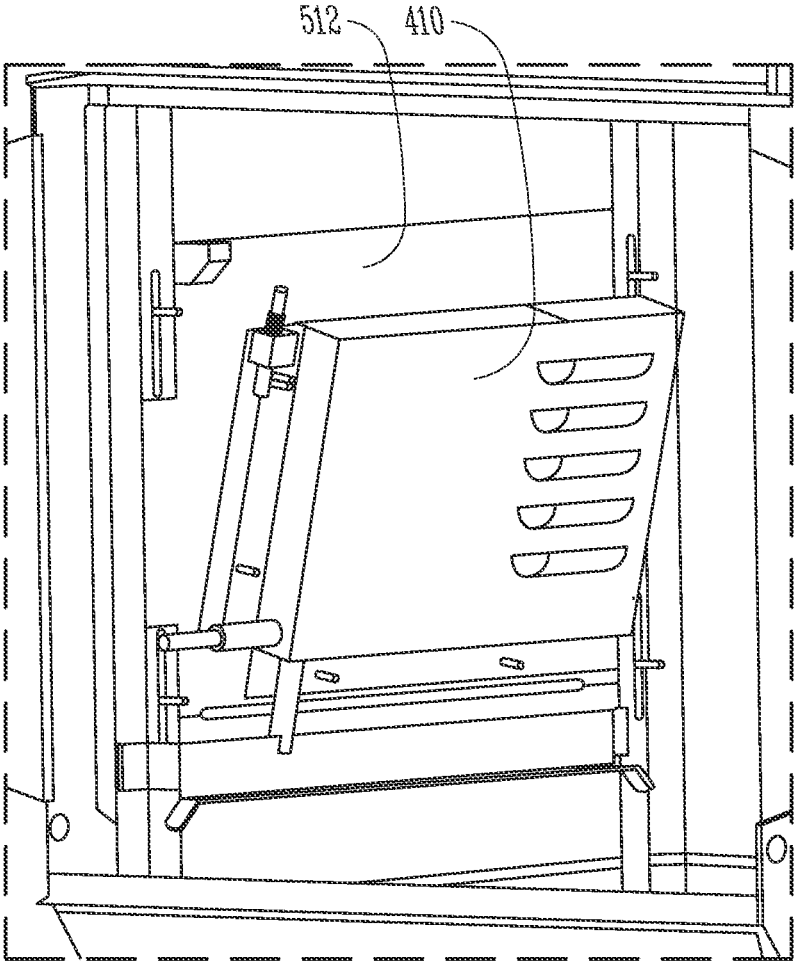
FIG. 6 is an illustration of an embodiment of mounting the dispenser of FIG. 4 into a dishwasher.
Figure 7:
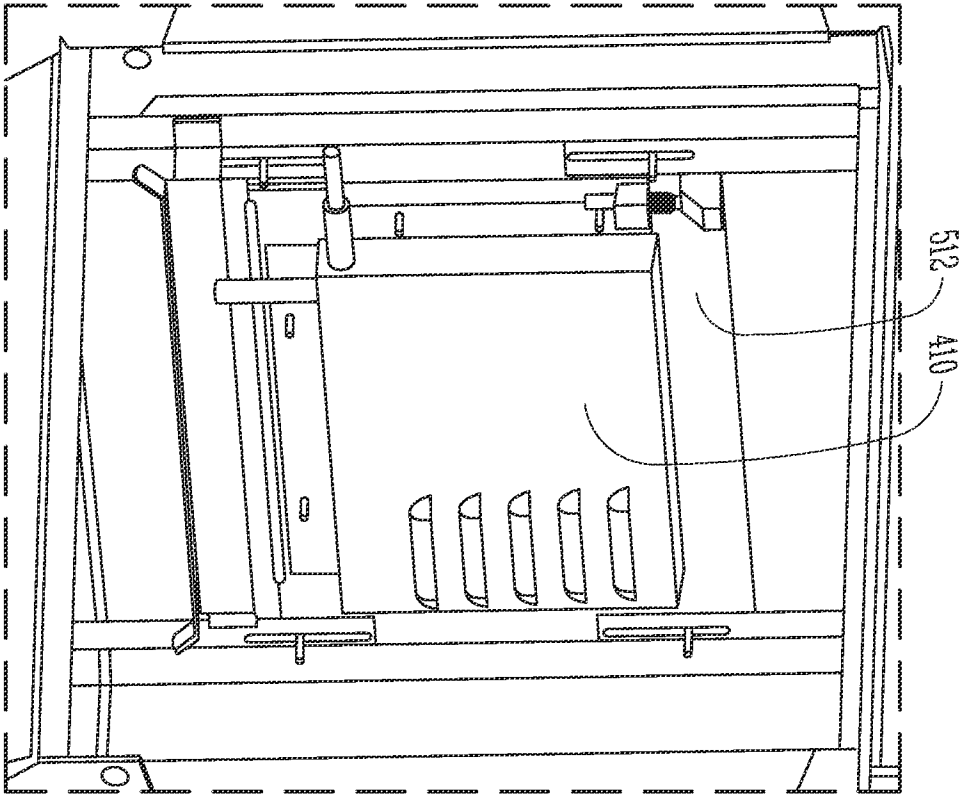
FIG. 7 is an illustration of an embodiment the dispenser of FIG. 4 mounted in the dishwasher.

FIG. 5 is an illustration of an embodiment of a mounting plate 512 for dispenser 410. Mounting plate 512 as shown in FIG. 5 is installed on an interior wall of the dishwasher. FIG. 6 is an illustration of an embodiment of mounting dispenser 410 into the dishwasher using mounting plate 512. FIG. 7 is an illustration of an embodiment of dispenser 410 mounted in the dishwasher. In the illustrated embodiment, dispenser 410 is detachably attached to mounting plate 512. Mounting plate 512 and structures allowing dispenser 410 to be attached to mounting plate 512 represent an example of mounting mechanism 212.

Figure 8:
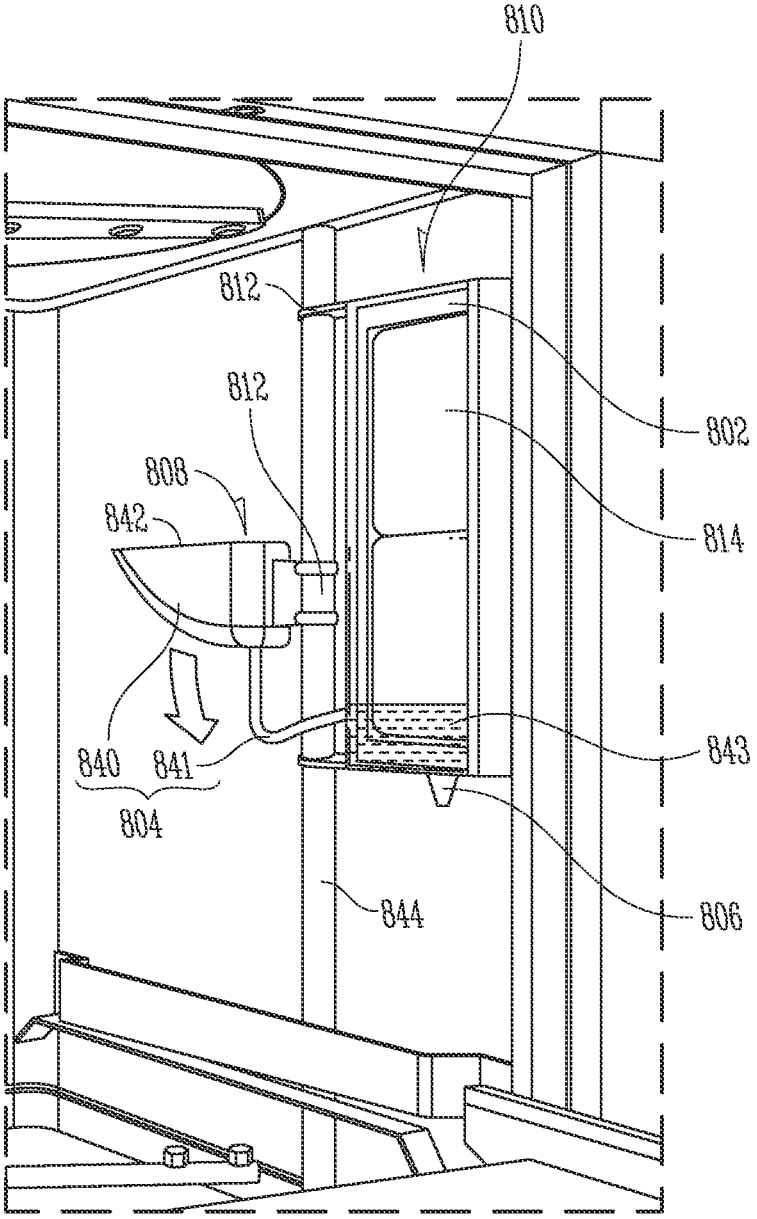
FIG. 8 is an illustration of another embodiment of a detergent dispensing system, such as may be implemented as the detergent dispensing system of FIG. 1 or FIG. 2, showing formation of a detergent solution from a solid detergent.

FIG. 8 is an illustration of an embodiment of a detergent dispensing system including a dispenser 810 for dispensing a detergent solution from a solid detergent into a dishwasher. Dispenser 810 represents another example of implementation of system 100 or an example of dispenser 210, and includes a detergent chamber 802, a liquid inlet 804, a liquid outlet 806, and a liquid level control mechanism 808.

Detergent chamber 802 represents an example of detergent chamber 102 and can accommodate one or more blocks of the solid detergent and the detergent solution. In the illustrated embodiment, detergent chamber 802 accommodates multiple blocks 814 of the solid detergent. Detergent chamber 802 can have a capacity allowing for loading additional one or more blocks of the solid detergent before the solid detergent in detergent chamber 802 is completely dissolved. Detergent chamber 802 can have a size suitable for mounting inside a dishwasher with minimal or no effect on the dishwasher's loading capacity and functioning. As an example, detergent chamber 802 can have a length between 25 and 45 cm, a width between 18 and 38 cm, and a height (thickness) of 1.5 and 3.5 cm, with approximately 34 cm×28 cm×2.5 cm being a specific example.

Liquid inlet 804 represents an example of liquid inlet 104 and includes a funnel 840 and a conduit 841 connected between funnel 840 and detergent chamber 802. Funnel 840 has a top opening 842 that is positioned and oriented to naturally collect the water sprayed during the washing and rinsing periods. Conduit 641 connects between an opening at the bottom of funnel 840 and an opening at or near the bottom of detergent chamber 802 to allow the collected water to flow into detergent chamber 802 to form the solid detergent shown as liquid 843 in detergent chamber 802 by dissolving a portion of multiple blocks 814 of the solid detergent.

Liquid outlet 806 represents an example of liquid outlet 106. In various embodiments, liquid outlet 806 includes a door-actuated valve. The valve is opened to release liquid 843 (the detergent solution) from detergent chamber 802 by opening the door of the dishwasher, and remains open while the door of the dishwasher is open. In various other embodiments, liquid outlet 806 allows for release of liquid 843 from detergent chamber 802 and can include an opening sized to control a speed of the release. In these various other embodiments, liquid outlet 806 may or may not include a valve (e.g., for adjustably controlling the size of the opening). Once formed in detergent chamber 802, liquid 843 is released continuously through liquid outlet 806 until detergent chamber 802 is empty.

Liquid level control mechanism 808 represents an example of liquid level control mechanism 108 and sets the liquid height limiting the level of liquid 843 (the detergent solution) in detergent chamber 802 using the position and/or orientation of funnel 840. In the illustrated embodiment, the position and orientation of top opening 842 of funnel 840 sets the liquid height as water pressure stops water collection by funnels 840 when the liquid levels in funnel 840 and detergent chamber 802 are equal. In one embodiment, the liquid height is adjustable by elevating or lowering funnel 840 and/or adjusting the orientation of top opening 842 of funnel 840.

Also shown in FIG. 8 is a mounting mechanism 812, which represents an example of mounting mechanism 212. In the illustrated embodiment, mounting mechanism 812 is used to position dispenser 810 adjacent an interior wall of the dishwasher by attaching dispenser to a pole 844 inside the dishwasher. Pole 844 may be a mounting structure (as part of mounting mechanism 812) installed inside the dishwasher. In one embodiment, mounting mechanism 812 allows dispenser 810 to be detached from pole 844.

Figure 9:
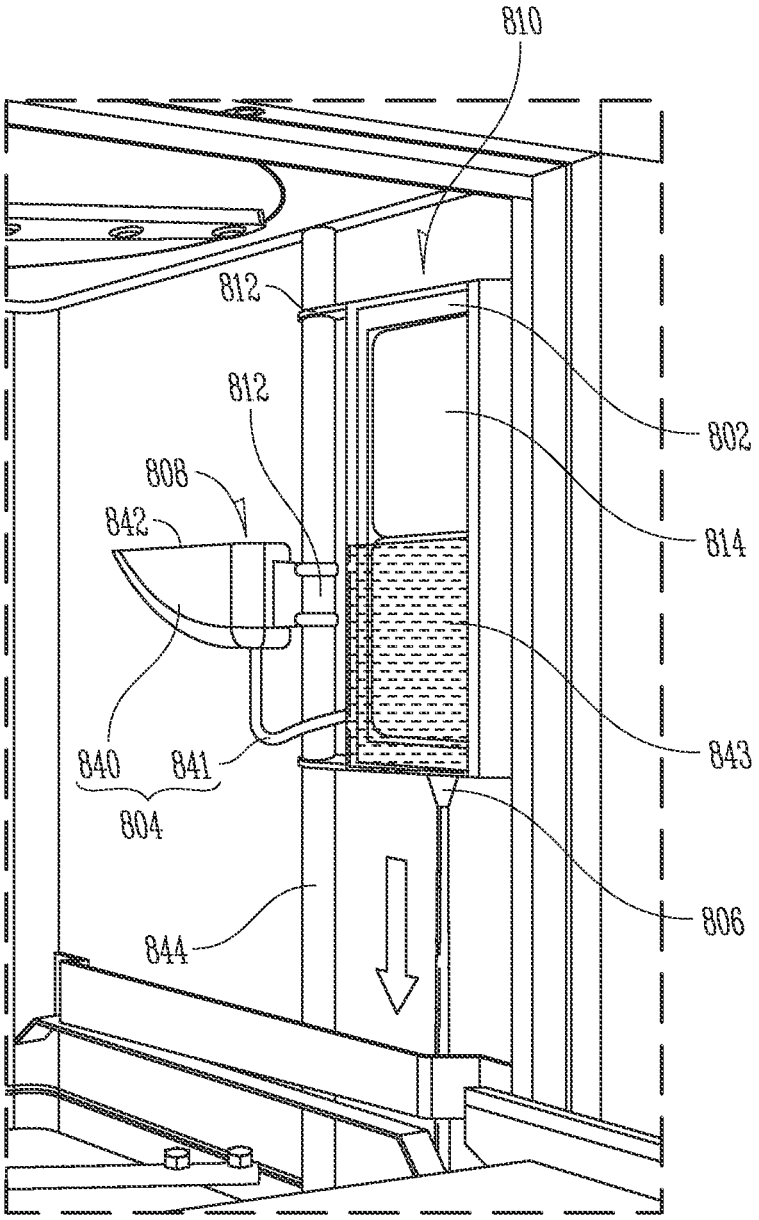
FIG. 9 is an illustration of the embodiment of the detergent dispensing system of FIG. 8, showing release of the detergent solution.

FIG. 9 is an illustration of the embodiment of the detergent dispensing system of FIG. 8, showing release of liquid 843 (the detergent solution) from detergent chamber 802. FIG. 9 also shows liquid 843 in detergent chamber 802 approximately reaches the liquid height.

Figure 10:
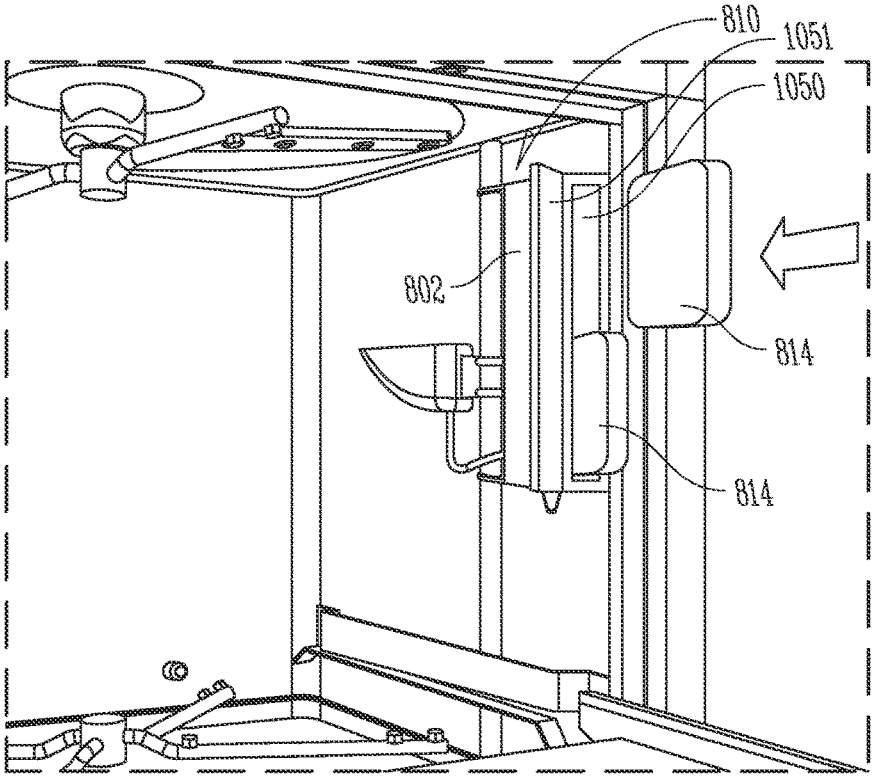
FIG. 10 is an illustration of the embodiment of the detergent dispensing system of FIG. 8, showing loading of blocks of the solid detergent.

FIG. 10 is an illustration of the embodiment the detergent dispensing system of FIG. 8, showing loading of multiple blocks 814 of the solid detergent into detergent chamber 802. Detergent chamber 802 includes a detergent opening 1050 to receive multiple blocks 814 of the solid detergent and a lid 1051 to close detergent opening 1050 for retaining the received receive multiple blocks 814 and liquid 843. In the illustrated embodiment, detergent opening 1050 is on a side of detergent chamber 802.

Figure 11:
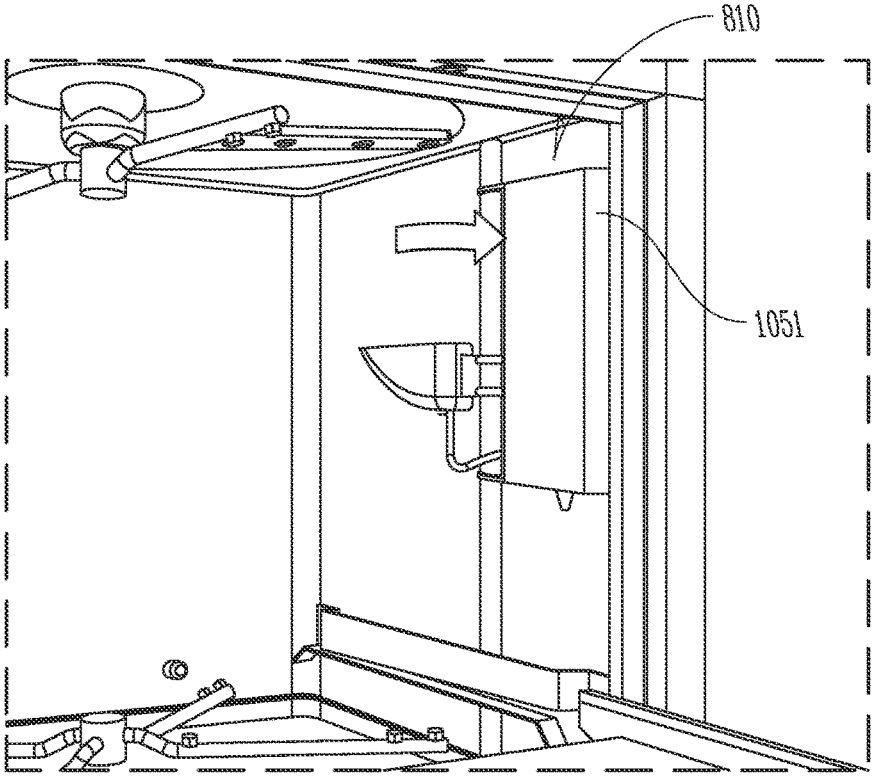
FIG. 11 is an illustration of the embodiment of the detergent dispensing system of FIG. 8, showing the system ready to operate after loading the blocks of solid detergent.

FIG. 11 is an illustration of the embodiment the detergent dispensing system of FIG. 8, showing the system ready to operate after loading multiple blocks 814 of the solid detergent, with lid 1051 being closed.

Some non-limiting examples (Examples 1-20) of the present subject matter are provided as follows.

In Example 1, a system for dispensing a detergent solution from a solid detergent into a dishwasher may include a detergent chamber, a liquid inlet, a liquid outlet, and a liquid level control mechanism. The dishwasher has a door and is capable of performing cleaning cycles each including washing and rinsing periods. The detergent chamber may be configured to accommodate the solid detergent and the detergent solution. The liquid inlet is in fluid communication with the detergent chamber and may be configured to collect water sprayed into the dishwasher during the washing and rinsing periods and to allow the collected water to flow into the detergent chamber to form the detergent solution by dissolving a portion of the solid detergent. The liquid outlet is in fluid communication with the detergent chamber and may be configured to automatically release the detergent solution from the detergent chamber between two consecutive cycles of the cleaning cycles. The liquid level control mechanism may be configured to set a liquid height limiting a level of the detergent solution in the detergent chamber.

In Example 2, the subject matter of Example 1 may optionally be configured to further include one or more tablets of the solid detergent, and such that the detergent chamber is configured to accommodate the one or more tablets and the detergent solution.

In Example 3, the subject matter of any one or any combination of Examples 1 and 2 may optionally be configured to include a dispenser configured to be retrofittable into the dishwasher. The dispenser includes the detergent chamber, the liquid inlet, the liquid outlet, and the liquid level control mechanism.

In Example 4, the subject matter of any one or any combination of Examples 1 to 3 may optionally be configured such that the liquid outlet includes a valve actuated by the door of the dishwasher. The value is configured to start releasing the detergent solution from the detergent chamber in response to an opening of the door of the dishwasher.

In Example 5, the subject matter of any one of Examples 3 and 4 may optionally be configured to further include a mounting mechanism configured to allow the dispenser to be internally mounted in the dishwasher.

In Example 6, the subject matter of Example 5 may optionally be configured such that the mounting mechanism includes a mounting plate configured to be mounted on an interior surface of the dishwasher, and the dispenser is configured to be detachably attached to the mounting plate.

In Example 7, the subject matter of any one or any combination of Examples 1 to 6 may optionally be configured such that the liquid inlet includes one or more water channels in fluid communication with the detergent chamber. The one or more water channels may be configured to receive the water and to guide the received water into the detergent chamber during the washing and rinsing periods.

In Example 8, the subject matter of Example 7 may optionally be configured such that the liquid level control mechanism includes a level control opening on the detergent chamber and a gate over a portion of the level control opening. The gate is adjustably positioned to set the liquid height in the detergent chamber by partially blocking the level control opening.

In Example 9, the subject matter of any one or any combination of Examples 1 to 6 may optionally be configured such that the liquid inlet includes a funnel and a conduit. The funnel has a top opening configured to collect water during the washing and rinsing periods. The conduit is configured to be connected between the funnel and the detergent chamber to allow the collected water to flow from the funnel to the detergent chamber.

In Example 10, the subject matter of Example 9 may optionally be configured such that the liquid level control mechanism includes the funnel positioned to set the liquid height.

In Example 11, a method for operating a detergent dispensing system in a dishwasher is provided. The dishwasher is capable of performing cleaning cycles each including washing and rinsing periods. The method may include: holding a solid detergent in a detergent chamber of the detergent dispensing system, collecting a portion of water sprayed into the dishwasher during the washing and rinsing periods and using the collected water to form a detergent solution in the detergent chamber by dissolving a portion of the solid detergent, automatically releasing the detergent solution from the detergent chamber between two consecutive cycles of the cleaning cycles, and setting a liquid height using mechanical means. The liquid height limits a level of the detergent solution in the detergent chamber.

In Example 12, the subject matter of holding the solid detergent as found in Example 11 may optionally include holding one or more blocks of the solid detergent.

In Example 13, the subject matter of any one or any combination of Examples 11 and 12 may optionally further include performing the holding, the collecting, the automatically releasing, and the setting using a dispenser configured to be retrofittable into the dishwasher.

In Example 14, the subject matter of Example 13 may optionally further include positioning the dispenser adjacent an interior wall of the dishwasher.

In Example 15, the subject matter of automatically releasing the detergent solution from the detergent chamber between two consecutive cycles of the cleaning cycles as found in any one or any combination of Examples 11 to 14 may optionally further include releasing the detergent solution from the detergent chamber in response to an opening of a door of the dishwasher.

In Example 16, the subject matter of Example 15 may optionally include releasing the detergent solution from the detergent chamber through a valve actuated by the door of the dishwasher.

In Example 17, the subject matter of any one or any combination of Examples 11 to 16 may optionally include collecting the portion of water sprayed into the dishwasher during the washing and rinsing periods and allowing the collected water to flow into the detergent chamber using one or more water channels connected to the detergent chamber.

In Example 18, the subject matter of Example 17 may optionally include setting the liquid height using a level control opening on the detergent chamber and a gate over a portion of the level control opening, the gate adjustably positioned to set the liquid height by partially blocking the level control opening.

In Example 19, the subject matter of any one or any combination of Examples 11 to 16 may optionally include collecting the portion of water sprayed into the dishwasher during the washing and rinsing periods and allowing the collected water to flow into the detergent chamber using a funnel in fluid communication with the detergent chamber.

In Example 20, the subject matter of Example 19 may optionally include setting the liquid height using at least one of a position or an orientation of the funnel.

This application is intended to cover adaptations or variations of the present subject matter. It is to be understood that the above description is intended to be illustrative, and not restrictive. The scope of the present invention should be determined with reference to the appended claims, along with the full scope of legal equivalents to which such claims are entitled.

What is claimed is:

1. A system for dispensing a detergent solution from a solid detergent into a dishwasher having a door and capable of performing cleaning cycles each including washing and rinsing periods, the system comprising:

a detergent chamber configured to accommodate the solid detergent and the detergent solution;

a liquid inlet in fluid communication with the detergent chamber, the liquid inlet configured to collect water sprayed into the dishwasher during the washing and rinsing periods and to allow collected water to flow into the detergent chamber to form the detergent solution by dissolving a portion of the solid detergent;

a liquid outlet in fluid communication with the detergent chamber and configured to allow release of the detergent solution from the detergent chamber; and a liquid level control mechanism configured to set a liquid height limiting a level of the detergent solution in the detergent chamber, wherein the liquid inlet includes a funnel having a funnel top opening configured to collect water, and the liquid level control mechanism is configured for positioning the funnel to set the liquid height by stopping collecting water when a level of collected water in the funnel and the level of the detergent solution in the detergent chamber are equal.

2. The system of claim 1, comprising a dispenser configured to be retrofittable into the dishwasher, the dispenser including the detergent chamber, the liquid inlet, the liquid outlet, and the liquid level control mechanism.

3. The system of claim 2, wherein the liquid outlet is configured to automatically release the detergent solution from the detergent chamber between two consecutive cycles of the cleaning cycles.

4. The system of claim 2, wherein the liquid outlet comprises an opening sized to control a speed of the release of the detergent solution from the detergent chamber.

5. The system of claim 2, wherein the liquid level control mechanism is configured to allow for adjustment of the liquid height.

6. The system of claim 5, wherein the liquid level control mechanism is configured to control a rate of the flow of the collected water into the detergent chamber.

7. The system of claim 5, wherein the funnel top opening has a position that is adjustable for the adjustment of the liquid height.

8. The system of claim 5, wherein the funnel top opening has an orientation that is adjustable for the adjustment of the liquid height.

9. The system of claim 2, further comprising the solid detergent, and wherein the detergent chamber is configured to hold one or more blocks of the solid detergent.

10. The system of claim 9, wherein the one or more blocks are each shaped as a rectangular tablet.

11. The system of claim 10, wherein the solid detergent comprises a washing agent, a rinsing agent, and a sanitization agent.

12. The system of claim 1, wherein the funnel has a funnel bottom and a funnel bottom opening at the funnel bottom, the detergent chamber has a detergent chamber bottom and comprises a detergent chamber opening at or near the detergent chamber bottom, and the liquid inlet further comprises a conduit configured to be connected between the funnel bottom opening and the detergent chamber opening to allow the collected water to flow from the funnel to the detergent chamber.

13. The system of claim 12, further comprising a mounting pole configured to be installed in the dishwasher and to allow the dispenser to be detachably attached to the mounting pole.

14. A system for dispensing a detergent solution from a solid detergent into a dishwasher having a door and capable of performing cleaning cycles each including washing and rinsing periods, the system comprising:

a detergent chamber configured to accommodate the solid detergent and the detergent solution;

a liquid inlet in fluid communication with the detergent chamber, the liquid inlet configured to collect water sprayed into the dishwasher during the washing and rinsing periods and to allow the collected water to flow into the detergent chamber to form the detergent solution by dissolving a portion of the solid detergent;

a liquid outlet in fluid communication with the detergent chamber and configured to allow release of the detergent solution from the detergent chamber; and a liquid level control mechanism configured to set a liquid height limiting a level of the detergent solution in the detergent chamber, wherein the liquid outlet comprises a valve actuated by the door of the dishwasher, the valve configured to start releasing the detergent solution from the detergent chamber in response to an opening of the door of the dishwasher.

15. The system of claim 14, further comprising a mounting mechanism configured to allow the dispenser to be internally mounted in the dishwasher.

16. The system of claim 15, wherein the mounting mechanism comprises a mounting plate configured to be mounted on an interior surface of the dishwasher, and the dispenser is configured to be detachably attached to the mounting plate.

17. The system of claim 15, wherein the liquid inlet comprises one or more water channels in fluid communication with the detergent chamber, the one or more water channels configured to receive the water and to guide the received water into the detergent chamber during the washing and rinsing periods.

18. The system of claim 17, wherein the liquid level control mechanism comprises:

a level control opening on the detergent chamber; and a gate over a portion of the level control opening, the gate adjustably positioned to set the liquid height in the detergent chamber by partially blocking the level control opening.

19. The system of claim 14, comprising a dispenser configured to be retrofittable into the dishwasher, the dispenser including the detergent chamber, the liquid inlet, the liquid outlet, and the liquid level control mechanism.

20. The system of claim 19, further comprising the solid detergent, wherein the solid detergent includes a washing agent, a rinsing agent, and a sanitization agent.

* * * * *